US005092097A

United States Patent [19]

Young

[11] Patent Number: 5,092,097

[45] Date of Patent: Mar. 3, 1992

[54] HOLDDOWN CONNECTOR

[75] Inventor: Daniel E. Young, Owatonna, Minn.

[73] Assignee: United Steel Products Co., Montgomery, Minn.

[21] Appl. No.: 580,120

[22] Filed: Sep. 10, 1990

[51] Int. Cl.[5] ..... E04B 1/38

[52] U.S. Cl. ..... 52/702; 52/264; 52/295; 52/713

[58] Field of Search ..... 52/702, 712, 295, 264, 52/293, 294, 295, 296, 289, 263, 713; 403/232.1, 190

[56] References Cited

U.S. PATENT DOCUMENTS

| | | | |
|---|---|---|---|
| 625,427 | 5/1899 | Stewart et al. | 403/232.1 |
| 717,316 | 12/1902 | Avery | 403/232.1 |
| 753,053 | 2/1904 | Eberhardt | 403/232.1 |
| 770,050 | 9/1904 | Dreyer | 403/232.1 |
| 874,514 | 12/1907 | Lindow | 403/232.1 |
| 4,594,017 | 6/1986 | Hills | 52/702 |
| 4,665,672 | 5/1987 | Commins et al. | 52/702 |
| 4,744,192 | 5/1988 | Commins | 403/232.1 |
| 4,825,621 | 5/1989 | Jensen | 52/702 |

*Primary Examiner*—Michael Safavi
*Attorney, Agent, or Firm*—Dorsey & Whitney

[57] ABSTRACT

A holddown connector for connecting a vertical member of a building structure to a foundation including a back plate, a pair of forwardly and downwardly extending side plates, a pair of inwardly extending, overlapped base plates with an aligned opening therethrough and a base plate washer positioned in face to face alignment with respect to the base plates and having a centrally located sleeve extending through the base plates and the aligned openings to tie the overlapped base plates together.

15 Claims, 2 Drawing Sheets

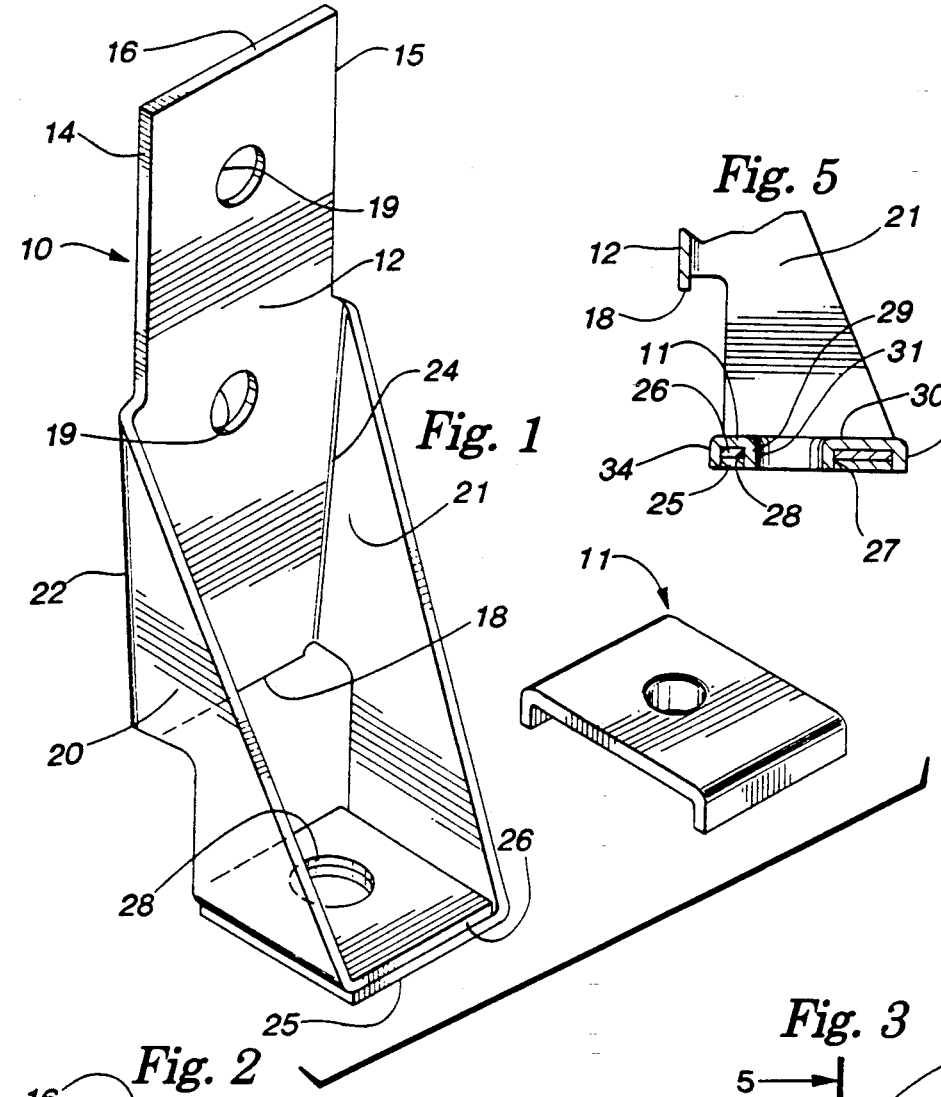
Fig. 1
Fig. 5
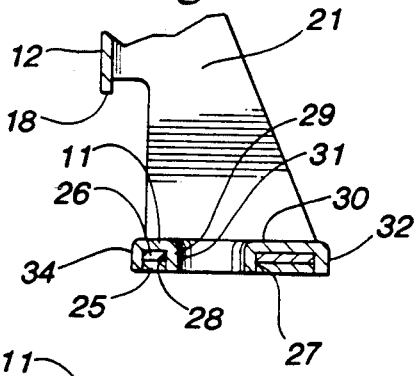
Fig. 2
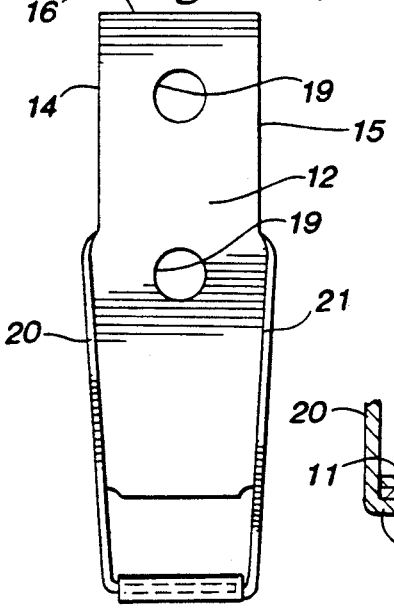
Fig. 3
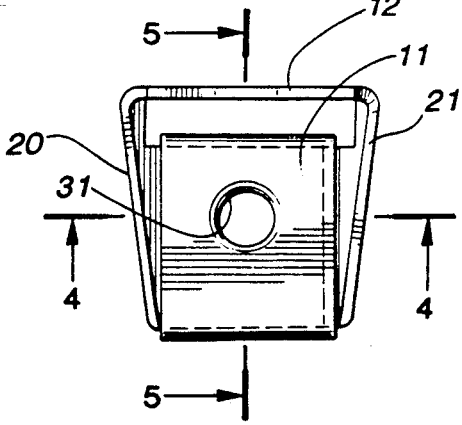
Fig. 4
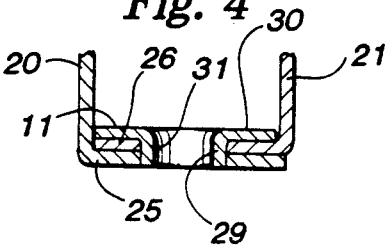

HOLDDOWN CONNECTOR

BACKGROUND OF THE INVENTION

1. Field of the Invention

The present invention relates generally to the field of structural connectors, and more particularly, to a holddown connector for connecting a vertical wood framing stud or the like to a generally horizontal foundation member usually formed of concrete, wood, or some combination thereof.

2. Description of the Prior Art

In the construction industry, vertical wooden stud elements are commonly connected to a wooden sill by toenailing or the like. The sill is in turn secured to a concrete foundation by threaded bolts anchored into the foundation or other similar connecting means. Although toenailing is generally a strong enough connection for withstanding most stresses placed on the building, it is inadequate to anchor the building to the foundation where the buildings are subject to significant seismic and wind loads such as those generated by earthquakes, hurricanes, typhoons and the like. For buildings which are subject to such forces, holddown connectors have been utilized to more securely connect the vertical studs, and thus the building structure, to the foundation.

In general, a holddown connector is a metallic connector having a generally vertical back plate with one or more openings for connection to a vertical stud, a pair of side plates integrally formed with the back plate and extending forwardly and downwardly from the edges thereof and a generally horizontally disposed base plate or seat extending between bottom edges of the side plates. The base plate includes an opening for connection to the generally horizontally disposed foundation or sill.

Several holddown connectors currently exist in the art. One such hold down is constructed of heavy gauge metal in which the back plate, side plates and base plate are individually fabricated, welded together and then painted. As a result, such connectors tend to be quite costly.

A second prior art holddown connector is illustrated in U.S. Pat. No. 4,665,672 issued to Commins et al. on May 19, 1987. This holddown connector is constructed from a single piece of sheet metal and includes a seat member formed with a bolt opening, a pair of side members integrally joined with the seat and a pair of overlapping back members formed with one or more overlapping and aligned openings for a connection to a vertical building stud.

A still further prior art holddown connector is illustrated in U.S. Pat. No. 4,825,621 issued to Jensen on May 2, 1989. This holddown is a one piece structure constructed of sheet metal stock and comprises a single back plate, a pair of side plates and a pair of overlapping first and second base plates with an aligned bolt opening extending therethrough.

Although each of the above identified prior art holddown structures provide adequate connection strength for connecting a vertical building member such as a wooden stud to a generally horizontal member such as a concrete foundation, certain limitations continue to exist with respect to such connectors. With respect to the first connector described above, the cost of fabrication is quite high because they are constructed of individual sections which are welded together to form a rigid structure and then painted.

Although the second and third holddown connectors described above overcome this limitation since they are fabricated from a single piece of sheet metal which is bent into the desired configuration, both of these structures embody either an overlapped back plate or an overlapped base or seat plate with aligned openings therein. Because the holes are normally drilled prior to bending and fabrication, the possibility exists for the aligned openings to be slightly misaligned thereby resulting in difficulty inserting a bolt or other threaded member therethrough. Secondly, because of the overlapped portions, such portions resist stresses individually until they engage the connecting bolt. Thus, there is some limited relative movement and deflection which can occur between the overlapped portions before the retaining feature of the bolt is actually utilized.

Accordingly, there is a continuing need in the art for an improved holddown connector which is essentially constructed of a single piece of material, but which also effectively eliminates the limitations of overlapped back or seat plates of prior connectors.

SUMMARY OF THE INVENTION

In contrast to the prior art, the present invention provides for a holddown connector which is constructed from a single piece of metal, but which also eliminates the potential problems resulting from overlapped backs plate or base plates. More specifically, the holddown connector of the present invention includes a single back plate having at least one connection opening, a pair of side plates extending forwardly from opposite side edges of the back plate, a pair of overlapping base plates with aligned openings and a flat tie-in washer portion positioned in face-to-face registration with one of the base plates and having a sleeve portion extending into the aligned base plate openings for a press fit connection therewith.

In the preferred embodiment of the present invention, the washer portion has a generally rectangular configuration with turned down lips at its opposite front and rear edges to increase the strength and stiffness of the washer portion. The sleeve portion of the preferred washer is extruded from a center portion of the washer and is press fit into engagement with the aligned openings of the base plate by a wedge member or other similar tapered tool.

With the holddown connector structure of the present invention as described above, each of the connection openings in the back plate and base plate functions as a single opening, thereby eliminating any alignment problems which can result when overlapped portions are utilized. Further, the use of the washer ties the overlapped base plates together so that they function as a single, integral unit. This tie-in significantly improves the strength and rigidity of the overlapped sections and limits the individual deflection of the overlapped portions resulting from stresses placed on the connector.

Accordingly, it is an object of the present invention to provide an improved holddown connector for connecting a vertical wall member such as a stud to a horizontal member such as a foundation.

Another object of the present invention is to provide a holddown connector constructed from a single piece of sheet metal and having means to eliminate the effect of overlapped portions of such connector.

A further object of the present invention is to provide a holddown connector constructed from a single piece of sheet metal having a base washer portion for securing the overlapped base plates together so that they function as a single unitary structure.

These and other objects of the present invention will become apparent, with reference to the drawings, the description of the preferred embodiment and the appended claims.

DESCRIPTION OF THE DRAWINGS

FIG. 1 is a perspective view of the holddown connector of the present invention with the base washer member broken away.

FIG. 2 is a front elevation view of the holddown connector of the present invention.

FIG. 3 is a top plan view of a fully assembled holddown connector in accordance with the present invention.

FIG. 4 is a fragmentary sectional view of the holddown connector of the present invention as viewed along the section line 4—4 of FIG. 3.

FIG. 5 is a fragmentary sectional view of the holddown connector of the present invention as viewed along the section line 5—5 of FIG. 3.

DESCRIPTION OF THE PREFERRED EMBODIMENT

Figure 6:
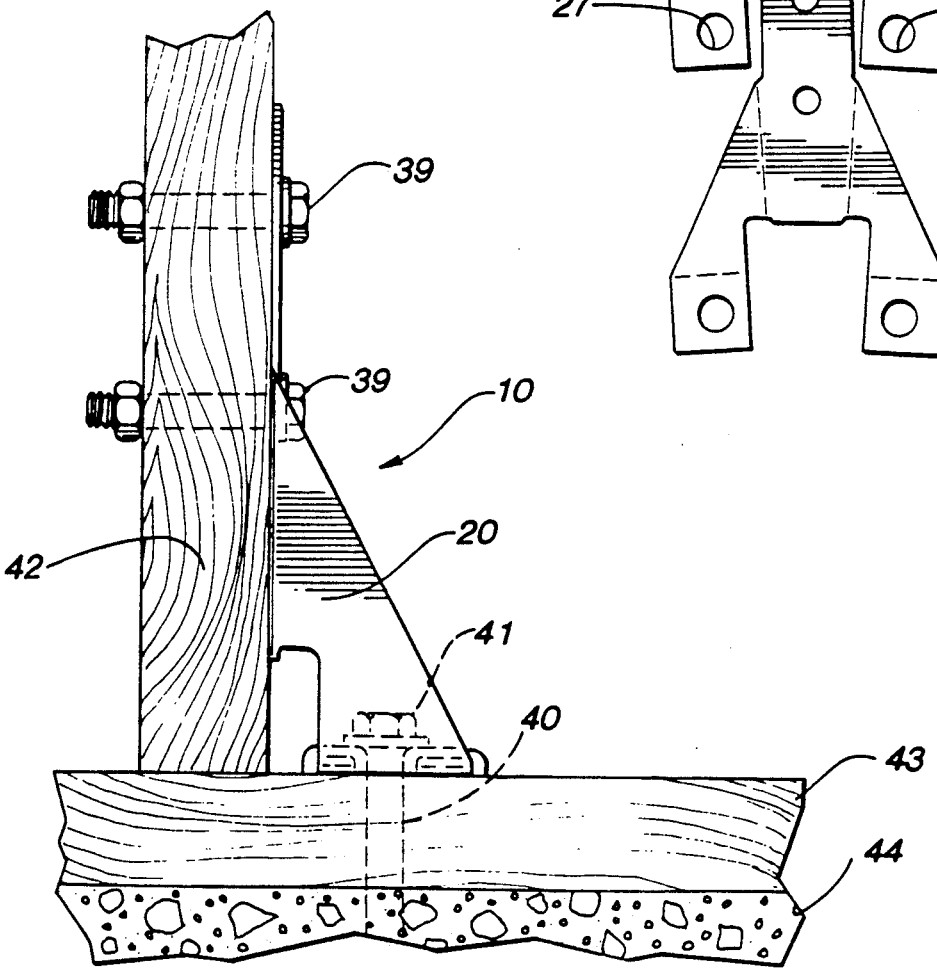
FIG. 6 is a side view, partially in section, of a holddown connector of the present invention connected to a vertical stud and a horizontal sill.

Reference is first made to FIG. 1 showing the holddown connector 10 of the present invention with the base washer member 11 broken away. The holddown connector of the present invention is constructed from a single sheet of sheet metal such as galvanized steel and includes a back plate 12, a pair of side plates 20 and 21, a pair of overlapping base plates 25 and 26 and a tie-in washer 11. The back plate 12 includes a pair of connection openings 19 for connection to a vertical member of a building structure such as the vertical stud 42 (FIG. 6). In the preferred embodiment, the back plate 12 is a generally rectangular member having a pair of side edges 14 and 15, a top edge 16 and a bottom edge 18. As shown best in FIG. 2, the lower portions of the back plate 12 converge slightly inwardly toward the bottom edge 18 along the bend lines 22 and 24 between the back plate 12 and the pair of side members 20, 21. Thus, the width of the back plate 12 at its top is slightly greater than the width at its bottom. This convergence of the back plate edges improves the rigidity of the structure and helps direct the retaining stresses toward the base plates. As illustrated best in FIGS. 1, 2 and 5, the back plate 12 terminates vertically above the connector base along the bottom edge 18.

Integrally formed with the back plate 12 along the bend line portions 22 and 24 of the side edges 14 and 15 are a pair of side plates 20 and 21. These side plates 20 and 21 are integrally joined with the back plate 12 and extend forwardly and downwardly as illustrated in FIG. 1. In the preferred embodiment, the side members 20 and 21 extend forwardly from the back plate 12 along the bend lines 22 and 24, respectively, at substantially right angles.

The lower ends of each of the side members 20 and 21 are bent inwardly toward one another in overlapping relationship to form a pair of base or seat plates 25 and 26. Specifically, the lower end of the side member 20 is bent inwardly to form the base plate 25 while the side member 21 is bent inwardly to form the base plate 26. As shown best in FIGS. 4 and 5, the base plates 25 and 26 are in general face-to-face alignment or registration with one another and each is provided with an aligned opening 27 and 28 therein. As illustrated best in FIG. 4, the side member 20 extends further downwardly than the side member 21 to permit the base plate 26 to be positioned above the base plate 25.

Positioned in face-to-face registration and engagement with the top base plate 26 is a separate base plate washer 11. The washer 11 includes a centrally positioned and integrally formed sleeve portion 29 and a generally top bolt supporting flat surface 30. The sleeve portion 29 includes a height approximating the combined thicknesses of the base plates 25 and 26 and is provided with an inner connection opening 31 for receiving a bolt or other threaded connection member for connecting the holddown connector 10 to a generally horizontal surface such as a building foundation 21 or a sill 22 (FIG. 6). In the preferred embodiment, the sleeve 29 is an extruded sleeve formed by first drilling or punching a small hole in the center of the washer 11 and then inserting a tapered wedge or tool into such hole to physically force the washer to conform to the sleeve configuration. During the fabrication process, the initial formation of the sleeve 29 is such that its outer cylindrical surface is slightly smaller than the diameter of the openings 27 and 28 in the base plates 25 and 26. This allows the sleeve 29 to be inserted into the openings 28. After such insertion, a tapered wedge or other tool is forced into the opening 31 to further cause the sleeve 29 to form a tight, press fit with the inner edges of the holes 27 and 28.

The forward and rearward edges of the washer 11 are bent downwardly as best illustrated in FIG. 5 to form a forward lip or flange 32 and a rearward lip or flange 34. As illustrated, the lips 32 and 34 extend across the entire width of the washer 11 and extend downwardly a distance approximately equal to the combined thicknesses of the base plates 25 and 26. The lip members 32 and 34 provide increased strength and rigidity to washer 11, thereby allowing the washer 11 to distribute the forces acting on the base plates 25 and 26, through the sleeve 29 and the main washer portion to the side members 20 and 21.

Figure 7:
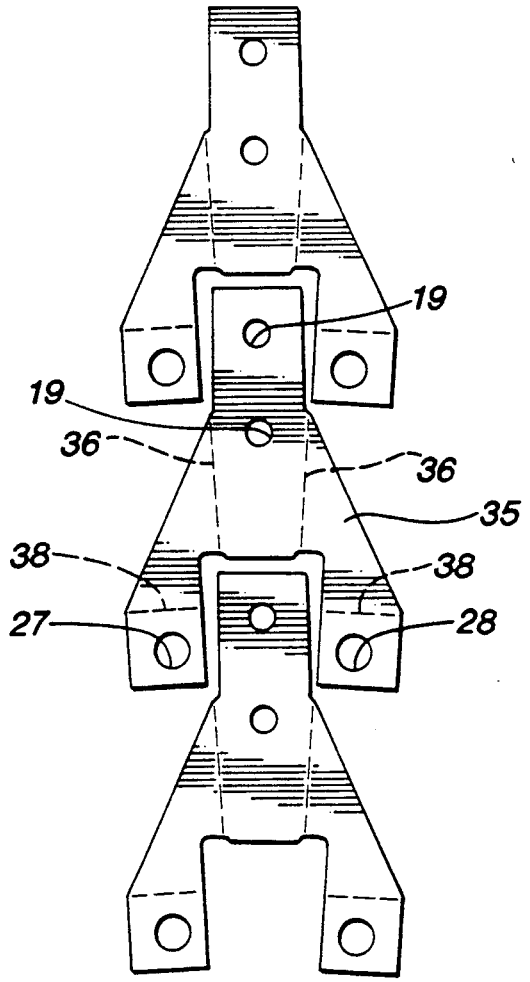
FIG. 7 is a top plan view of several of the holddown connectors as they are manufactured from a continuous strip of sheet metal stock.

In the preferred embodiment, the holddown connector 10 is constructed from a single piece of sheet metal which is cut from a continuous strip of such metal as illustrated in FIG. 7. In FIG. 7, a plurality of connector blanks 35 are cut from a continuous strip of sheet metal such as galvanized steel. The connector 10 is fabricated in a progressive die by first cutting the individual blanks 35 from the piece of sheet metal. During this cutting process, portions between the interlocking parts of the blank 35 are discarded. This is followed by drilling or punching the holes 19 in the back plate portion and the holes 27 and 28 in the base plates 25 and 26 and then forming the back plate 12, the side plates 20 and 21 and the base plates 25 and 26 by bending the blank 35 along the various bend lines 36 and 38 as illustrated in broken lines in FIG. 7. Although various thicknesses and types of sheet metal may be used for fabricating the connector 10, the preferred embodiment contemplates that the main portion of the connector 10 be fabricated from 10 gauge or 12 gauge galvanized steel. The washer 11 of the preferred embodiment is fabricated from 10 gauge galvanized steel.

The washer 11 is similarly fabricated using a progressive die by first cutting out a generally rectangular shaped blank. This is followed by drilling or otherwise forming a small hole in the center of the washer and then extruding or otherwise forming the sleeve portion 29 by forcing a tapered wedge or tool into such opening and physically forcing the metal into the configuration of the sleeve 29 as illustrated best in FIGS. 4 and 5. During this initial extrusion process, the outer dimension of the sleeve 29 is slightly smaller than the diameter of the openings 27 and 28 in the base plates 25 and 26. Prior to or following formation of the sleeve 29, the forward and rearward lips 32 and 34 are bent into the configuration illustrated in FIG. 5.

Following fabrication of the washer 11, the washer 11 is joined with the main portion of the holddown connector 10 by inserting the sleeve 29 into the aligned base plate openings 28. This is followed by inserting a wedge or tapered tool into the sleeve and further expanding the sleeve 29 so that it forms a tight fit with the inner edges of the base plate openings 27 and 28. This results in a structure in which the overlapped portions of the base are tied together and function as a single unit, thereby providing easy alignment of the sleeve opening 31 with a connection bolt and limiting the bending and deflection movements of the base plates 25 and 26.

Use of the holddown connector 10 is illustrated best in FIG. 6. Specifically, the connector 10 is utilized to connect a vertical member of a building structure such as a stud 42 to a horizontal concrete foundation 44 or to a wooden sill 43 connected to the top surface of the concrete foundation 44. The connector 10 is secured to the stud 42 by a pair of bolts 39 or other threaded connectors extending through the connection openings 19 (FIG. 1) and through the stud 42. Connection to the sill 43 and foundation 44 is through an anchor bolt or threaded member 40 embedded in the concrete foundation 44 and extending upwardly from the sill 43 and through the base plate members 25 and 26 and the washer 11 where it is capped by a threaded nut 41.

Although the description of the preferred embodiment has been quite specific, it is contemplated that various modifications could be made without deviating from the spirit of the present invention. Accordingly, it is contemplated that the scope of the present invention be dictated by the appended claims rather than by the description of the preferred embodiment.

I claim:

1. A holddown connector for connecting a generally vertical member of a building structure to a generally horizontal member such as a foundation comprising:

a back plate having front and rear surfaces and a pair of side edges and having at least one connection opening therein for connection to said vertical member;

a pair of side plates connected integrally with said back plate and extending forwardly, from said back plate along bend lines defined by a portion of the side edges of said back plate;

a pair of base plates integrally and correspondingly connected with said side plates and extending inwardly from said side plates toward one another in overlapping, face-to-face relationship, said pair of base plates being disposed at generally right angles relative to said back plate and having aligned openings therein; and a washer having a generally flat surface portion extending in general face-to-face relationship with one of said base plates and including a sleeve portion extending outwardly from said surface portion and through said aligned openings, said sleeve having an outer dimension approximating the dimension of said aligned openings so that said sleeve portion is retained within said aligned opening by an interference fit and an inner dimension defining an opening for connection with said horizontal member.

2. The holddown connector of claim 1 wherein said pair of side edges includes converging portions converging toward one another.

3. The holddown connector of claim 2 wherein said side plates are connected to said back plate along said converging portions.

4. The holddown connector of claim 3 wherein the width dimension at the upper end of said back plate is greater than the width dimension of said base plates.

5. The holddown connector of claim 1 wherein the width dimension of the upper end of said back plate is greater than the width dimension of said base plates.

6. The holddown connector of claim 1 wherein said washer includes forward and rearward edges and one of said forward and rearward edges includes a flange extending outwardly from said surface portion.

7. The holddown connector of claim 6 wherein said flange extends outwardly from said surface portion in the same direction as said sleeve portion.

8. The holddown connector of claim 7 wherein each of said forward and rearward edges includes a flange extending outwardly from said surface portion.

9. The holddown connector of claim 8 wherein said washer is positioned on top of said base plates and said flanges extend downwardly past an edge portion of at least one of said base plates.

10. The holddown connector of claim 4 wherein said washer includes forward and rearward edges and one of said forward and rearward edges includes a flange extending outwardly from said surface portion.

11. The holddown connector of claim 10 wherein said flange extends outwardly from said surface portion in the same direction as said sleeve portion.

12. The holddown connector of claim 11 wherein each of said forward and rearward edges includes a flange extending outwardly from said surface portion.

13. The holddown connector of claim 12 wherein said washer is positioned on top of said base plates and said flanges extend downwardly past an edge portion of at least one of said base plates.

14. The holddown connector of claim 1 wherein said sleeve extends outwardly from said surface portion a distance greater than the thickness of one of said base plates.

15. The holddown connector of claim 14 wherein said sleeve extends outwardly from said surface portion a distance approximately equal to the combined thickness of said base plates.

* * * * *